US007927690B2

(12) United States Patent
Taguchi et al.

(10) Patent No.: US 7,927,690 B2
(45) Date of Patent: Apr. 19, 2011

(54) NONWOVEN FABRIC MADE OF AN ETHYLENE/TETRAFLUOROETHYLENE COPOLYMER

(75) Inventors: Daisuke Taguchi, Chiyoda-ku (JP); Ken Iruya, Chiyoda-ku (JP); Seigo Kotera, Chiyoda-ku (JP)

(73) Assignee: Asahi Glass Company, Limited, Tokyo (JP)

( * ) Notice: Subject to any disclaimer, the term of this patent is extended or adjusted under 35 U.S.C. 154(b) by 0 days.

(21) Appl. No.: 12/398,656

(22) Filed: Mar. 5, 2009

(65) Prior Publication Data

US 2009/0226690 A1 Sep. 10, 2009

(30) Foreign Application Priority Data

Mar. 6, 2008 (JP) ..... 2008-055907
Apr. 15, 2008 (JP) ..... 2008-105534

(51) Int. Cl.
*B32B 7/02* (2006.01)
*D04H 1/00* (2006.01)

(52) U.S. Cl. ..... 428/219; 442/327; 442/340; 442/400; 442/409

(58) Field of Classification Search ..... 428/219; 442/327, 340, 400, 409
See application file for complete search history.

(56) References Cited

U.S. PATENT DOCUMENTS 5,470,663 A * 11/1995 Wadsworth et al. ..... 428/421
2005/0214611 A1* 9/2005 Hommura ..... 429/30

FOREIGN PATENT DOCUMENTS

JP 7-229048 8/1995
JP 2002-266219 9/2002

* cited by examiner

*Primary Examiner* — Norca L Torres-Velazquez
(74) *Attorney, Agent, or Firm* — Oblon, Spivak, McClelland, Maier & Neustadt, L.L.P.

(57) ABSTRACT

It is an object of the present invention to provide a nonwoven fabric which is excellent in the heat resistance and the chemical resistance, of which the fiber diameter is small, which is excellent in the strength and of which the maximum pore diameter is small.

A nonwoven fabric made of an ethylene/tetrafluoroethylene copolymer, characterized in that the nonwoven fabric is mutually fused continuous fibers of an ethylene/tetrafluoroethylene copolymer which has a melt viscosity of from higher than 100 to 1,500 Pa·s at 240° C.

9 Claims, 2 Drawing Sheets

NONWOVEN FABRIC MADE OF AN ETHYLENE/TETRAFLUOROETHYLENE COPOLYMER

BACKGROUND OF THE INVENTION

1. Field of the Invention

The present invention relates to a nonwoven fabric made of an ethylene/tetrafluoroethylene copolymer.

2. Discussion of Background

Nonwoven fabrics are used as fiber materials suitable for reinforcing filters, electrolyte membranes, is etc.

As polymer materials for the nonwoven fabric, general-purpose materials such as polypropylene resins, polyester resins or polyamide resins have been mainly used. However, a fluororesin which is excellent in heat resistance, chemical resistance, non-stickiness and cleanness has been proposed as a material for an air-cleaning ultra high performance filter or a chemical filter in the field of semiconductors, a filter bag for an antipollution measures, etc.

There is a method wherein a polytetrafluoroethylene (PTFE) resin as such a fluororesin, is stretched, cut and formed into fibers, followed by a water jet method or a needle punching method to form a nonwoven fabric. However, the strength of such a nonwoven fabric is insufficient, since fibers are not mutually fused.

On the other hand, in a case where a nonwoven fabric product is produced by meltblowing a thermoplastic fluororesin, there are problems such that it is difficult to form the thermoplastic fluororesin into fine fibers, and the nonwoven fabric thereby obtained is poor in strength.

It is disclosed that a nonwoven fabric is produced by meltblowing an ethylene-chlorotrifluoroethylene copolymer (Patent Document 1). However, the nonwoven fabric thereby obtained is insufficient in the chemical resistance, the water repellency, the stainproofing property, the mold release characteristic, etc.

Further, it has been proposed that a nonwoven fabric is produced by meltblowing a tetrafluoroethylene copolymer having a low melt viscosity (Patent Document 2). However, since the melt viscosity of the tetrafluoroethylene copolymer is too low, the molding property is insufficient. Further, there are problems such that the handling efficiency at the time of production is insufficient, and the average fiber diameter of the nonwoven fabric thereby obtained is so small that the strength is poor. Further, if the average fiber diameter of the nonwoven fabric is increased in order to improve the strength, in a case where such a nonwoven fabric is used as a filter for removing fine particles, the maximum pore diameter becomes so large that the property for removing fine particles is poor.

On the other hand, in a case where a nonwoven fabric is produced by meltblowing an ethylene/tetrafluoroethylene copolymer which is used for generic molding, since the melt viscosity of the ethylene/tetrafluoroethylene polymer is high, the average fiber diameter of the nonwoven fabric becomes large, and if such a nonwoven fabric is used for a filter for removing fine particles, the maximum pore diameter becomes so large that the performance of removing fine particles is insufficient.

Patent Document 1: JP-A-7-229048

Patent Document 2: JP-A-2002-266219

SUMMARY OF THE INVENTION

It is an object of the present invention to provide a nonwoven fabric which is excellent in the heat resistance and the chemical resistance, of which the fiber diameter is small, which is excellent in the mechanical strength and of which the maximum pore diameter is small.

The present invention provides a nonwoven fabric having the following constructions.

(1) A nonwoven fabric made of an ethylene/tetrafluoroethylene copolymer, characterized in that the nonwoven fabric is mutually fused continuous fibers of an ethylene/tetrafluoroethylene copolymer which has a melt viscosity of from higher than 100 to 1,500 Pa·s at 240° C.

(2) The nonwoven fabric made of an ethylene/tetrafluoroethylene copolymer according to the above (1), wherein the average fiber diameter of the continuous fibers is from 0.01 to 5 μm.

(3) The nonwoven fabric made of an ethylene/tetrafluoroethylene copolymer according to the above (1) or (2), wherein the maximum pore diameter of the nonwoven fabric is at most 100 μm.

(4) The nonwoven fabric made of an ethylene/tetrafluoroethylene copolymer according to any is one of the above (1) to (3), wherein the unit weight of the nonwoven fabric is from 1 to 300 g/m$^2$.

(5) The nonwoven fabric made of an ethylene/tetrafluoroethylene copolymer according to any one of the above (1) to (4), wherein the strength of the nonwoven fabric per unit weight 100 g/m$^2$ in the machine direction is at least 0.5 kg/5 cm.

(6) The nonwoven fabric made of an ethylene/tetrafluoroethylene copolymer according to any one of the above (1) to (5) wherein the nonwoven fabric is produced by meltblow process.

(7) The nonwoven fabric made of an ethylene/tetrafluoroethylene copolymer according to any one of the above (1) to (6), wherein the ethylene/tetrafluoroethylene copolymer comprises repeating units based on tetrafluoroethylene, repeating units based on ethylene and repeating units based on a fluoroolefin represented by the formula $CH_2{=}CX(CF_2)_nY$ (where each of X and Y which are independent of each other is a hydrogen atom or a fluorine atom, and n is an integer of from 2 to 8), the molar ratio of the repeating units based on tetrafluoroethylene/the repeating units based on ethylene is from 90/10 to 35/65, and the content of the repeating units based on the fluoroolefin is from 0.01 to 10 mol % based on the total repeating units in the ethylene/tetrafluoroethylene copolymer.

(8) The nonwoven fabric made of an ethylene/tetrafluoroethylene copolymer composition according to the above (7), wherein the molar ratio of the repeating units based on tetrafluoroethylene/the repeating units based on ethylene is from 75/25 to 55/45, and the content of the repeating units based on the fluoroolefin is from 0.4 to 4 mol % based on the total repeating units in the ethylene/tetrafluoroethylene copolymer.

(9) The nonwoven fabric made of an ethylene/tetrafluoroethylene copolymer according to any one of the above (1) to (8), wherein the mutual fusion of the continuous fibers is carried out by hot pressing the nonwoven fabric of the continuous fibers to fuse intersections among the fibers.

The nonwoven fabric made of the ethylene/tetrafluoroethylene copolymer of the present invention is excellent in productivity, since its material is an ethylene/tetrafluoroethylene copolymer having a high melt flowability. Further, it is possible to provide a nonwoven fabric which is excellent in the heat resistance and the chemical resistance, of which the average fiber diameter is small, which is excellent in the mechanical strength and of which the maximum pore diameter is small.

EXPLANATION OF NUMERALS

Figure 1:
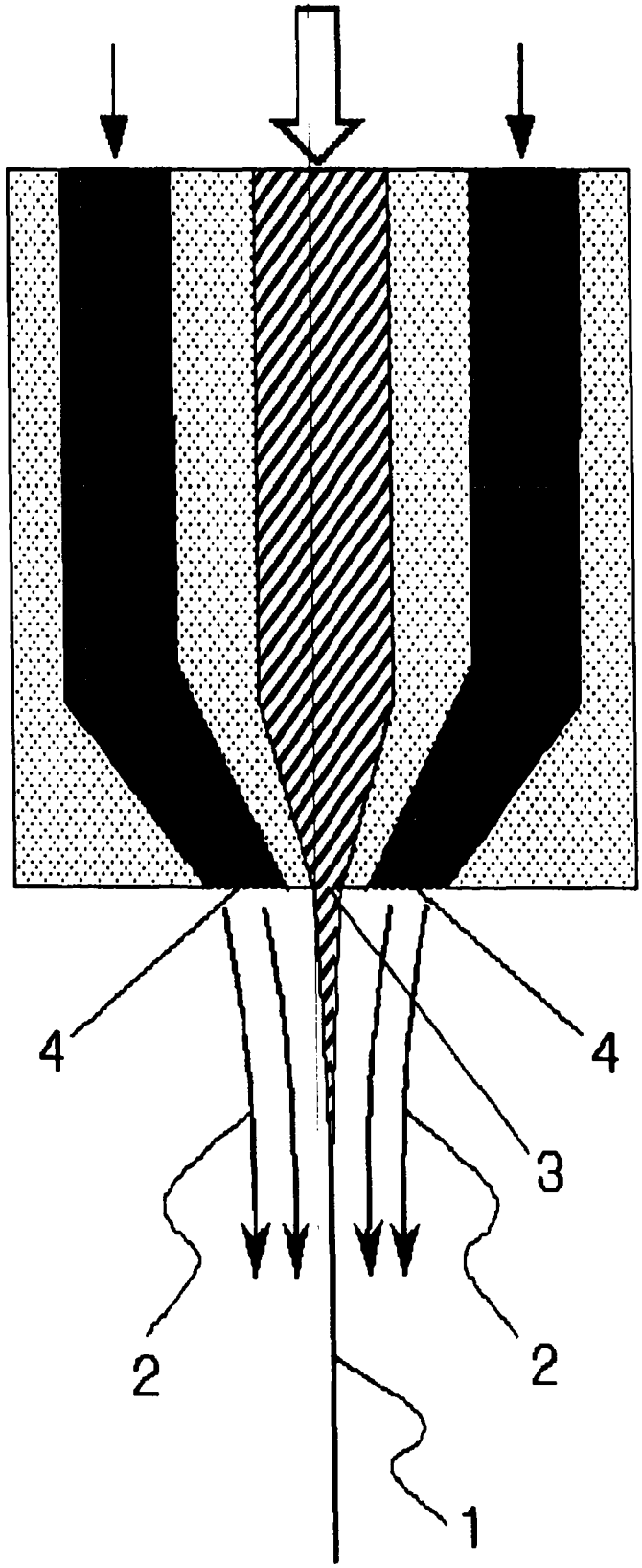
FIG. 1 is a cross-sectional view illustrating one embodiment in cross section of a nozzle used in an apparatus for producing a melt-blown nonwoven fabric.

1: ETFE
2: Gas
3: Outlet of spinning nozzle
4: Outlet of gas discharge nozzle
5: Raw fabric roll of ETFE nonwoven fabric
6: ETFE nonwoven fabric
7: Raw fabric roll of PET base material film
8: PET base material film
9: Guide roll
10: Guide roll
11: Metal roll
12: Rubber roll
13: PET base material film supported-densified nonwoven fabric wind-up roll

DETAILED DESCRIPTION OF THE PREFERRED EMBODIMENTS

Melt Viscosity

In the present invention, the melt viscosity at 240° C. of the ethylene/tetrafluoroethylene copolymer (hereinafter referred to as ETFE) which constitutes the nonwoven fabric is from higher than 100 Pa·s to 1,500 Pa·s, preferably from 100 to 1,300 Pa·s.

When the melt viscosity of ETFE is within the above range, ETFE has a high melt flowability, and the productivity of the nonwoven fabric at the time of production is excellent.

As the ETFE, it is basically preferred to employ ETFE having a low melt viscosity. Further, as the ETFE, one type of ETFE may be used, or a mixture of two or more types of ETFE may be used.

So far as the melt viscosity of an ETFE mixture at 240° C. is within the above range, the mixture of two or more types of ETFE may be a mixture of ETFE having a low melt viscosity and ETFE having a high melt viscosity. For example, ETFE is preferably a mixture containing an ethylene/tetrafluoroethylene copolymer (A) (hereinafter referred to as ETFE (A)) having a melt viscosity of from 60 to 400 Pa·s at 240° C. and an ethylene/tetrafluoroethylene copolymer (B) (hereinafter referred to as ETFE (B)) having a melt viscosity of from 600 to 10,000 Pa·s at 240° C. with a mass ratio of (A)/(B)=50/50 to 99/1.

The melt viscosity of ETFE (A) at 240° C. is more preferably from 80 to 300 Pa·s, and the melt viscosity of ETFE (B) at 240° C. is more preferably from 1,000 to 7,000 Pa·s. If the melt viscosity of ETFE (A) or ETFE (B) is higher than the above ranges, sufficient melt flowability cannot be obtained. On the other hand, if the melt viscosity is lower than the above ranges, tensile elongation of a molded product to be obtained may sometimes not be sufficient.

Further, the mixing mass ratio of ETFE (A)/ETFE (B) is preferably from 60/40 to 97/3, more preferably from 70/30 to 95/5.

Measurement of Melt Viscosity

The range of the melt viscosity (the melt flowability) in the present invention is preferably measured by a capillary flowability-measuring apparatus (capillary rheometer). This is one wherein a molten resin is extruded at a constant speed to let it pass through a capillary, whereby the stress required for the extrusion is measured to obtain the melt viscosity. The lower the melt viscosity of ETFE, the lower the molecular weight of the ETFE, and the higher the melt viscosity, the higher the molecular weight of the ETFE.

The melt flowability of ETFE in the present invention is measured, e.g. as disclosed in Examples given hereinafter, by setting an orifice having a diameter of 1 mm and a length of 10 mm on a capillary rheometer "Capirograph" having an inner diameter of 9.55 mm (manufactured by Toyo Seiki Seisakusho, Ltd.), under such conditions that the cylinder temperature is 240° C., and the piston speed is 10 mm/min.

Here, the temperature for melting ETFE is preferably a temperature higher by from 5 to 30° C. than the melting point of the ETFE. If the measurement is carried out under a condition lower than this temperature, ETFE will not sufficiently melt, whereby the measurement tends to be difficult, and if the measurement is carried out under a condition excessively higher than this temperature, the viscosity of ETFE tends to be too low, and molten ETFE will flow out of the orifice in a short time, whereby the measurement tends to be difficult.

Melting Point

The melting point of ETFE in the present invention is preferably from 120 to 240° C., more preferably from 150 to 240° C., most preferably from 180 to 240° C.

The melting point of ETFE in the present invention is one obtained from the heat absorption peak when it is heated in an air atmosphere from room temperature to 300° C. at a rate of 10° C./min by means of a scanning differential calorimeter (DSC220CU, manufactured by Seiko Instruments Inc.), as shown in Examples given hereinafter.

Copolymer Composition of ETFE

ETFE contains repeating units based on tetrafluoroethylene (hereinafter sometimes referred to as "TFE") and repeating units based on ethylene (hereinafter sometimes referred to as "E"), and the content ratio (molar ratio) is preferably from 90/10 to 35/65, more preferably from 80/20 to 45/55, most preferably from 75/25 to 55/45.

If the molar ratio of (repeating units based on TFE)/(repeating units based on E) is extremely large, there may be a case where the heat resistance, the weather resistance, the chemical resistance, the property to prevent permeation of a reagent, etc. deteriorate. On the other hand, if such a molar ratio is extremely small, there may be a case where the mechanical strength, the melt moldability, etc. deteriorate. When the molar ratio is within this range, the ETFE will be one excellent in the heat resistance, the weather resistance, the chemical resistance, the property to prevent permeation of a reagent, the mechanical strength, the melt moldability, etc.

Further, ETFE may contain, in addition to the above mentioned repeating units based on E and repeating units based on TFE, repeating units based on at least one type of other monomers within a range not impair the essential properties.

As such other monomers, an α-olefin such as propylene or normal butene or isobutene; a compound represented by $CH_2{=}CX(CF_2)_nY$ (wherein each of X and Y which are independent of each other, is hydrogen or a fluorine atom, and n is an integer of from 2 to 8); a fluoroolefin having hydrogen atoms in an unsaturated group, such as vinylidene fluoride (VDF), vinyl fluoride (VF), trifluoroethylene or hexafluoroisobutylene (HFIB); and a fluoroolefin having no hydrogen atoms in an unsaturated group (excluding TFE) such as hexafluoropropylene (HFP), chlorotrifluoroethylene (CTFE), perfluoro(methyl vinyl ether) (PMVE), perfluoro (ethyl vinyl ether) (PEVE), perfluoro(propyl vinyl ether) (PPVE), perfluoro(butyl vinyl ether) (PBVE) or other perfluoro(alkyl vinyl ether) (PAVE) may, for example, be mentioned. One or more of such other monomers may be employed.

The content of repeating units based on such other monomers in ETFE is preferably from 0.01 to 20 mol %, more preferably from 0.1 to 15 mol %, further preferably from 1 to 10 mol %, based on the entire repeating units in ETFE.

As such other monomers, it is particularly preferred to use the above mentioned compound represented by the formula $CH_2{=}CX(CF_2)_nY$ (hereinafter referred to as "FAE") among them. As mentioned above, FAE is a compound represented by the formula $CH_2{=}CX(CF_2)_nY$ (wherein each of X and Y which are independent of each other, is a hydrogen atom or a fluorine atom, and n is an integer of from 2 to 8). In the formula, if n is less than 2, the properties of ETFE may tend to be inadequate (for example, formation of stress cracks in the ETFE molded product). On the other hand if n in the formula exceeds 8, there may be a case where such is disadvantageous from the viewpoint of the polymerization reactivity.

FAE may, for example, be $CH_2{=}CF(CF_2)_2F$, $CH_2{=}CF(CF_2)_3F$, $CH_2{=}CF(CF_2)_4F$, $CH_2{=}CF(CF_2)_5F$, $CH_2{=}CF(CF_2)_8F$, $CH_2{=}CF(CF_2)_2H$, $CH_2{=}CF(CF_2)_3H$, $CH_2{=}CF(CF_2)_4H$, $CH_2{=}CF(CF_2)_5H$, $CH_2{=}CF(CF_2)_8H$, $CH_2{=}CH(CF_2)_2F$, $CH_2{=}CH(CF_2)_3F$, $CH_2{=}CH(CF_2)_4F$, $CH_2{=}CH(CF_2)_5F$, $CH_2{=}CH(CF_2)_8F$, $CH_2{=}CH(CF_2)_2H$, $CH_2{=}CH(CF_2)_3H$, $CH_2{=}CH(CF_2)_4H$, $CH_2{=}CH(CF_2)_5H$, or $CH_2{=}CH(CF_2)_8H$. One or more FAE may be employed.

Among them, a compound represented by $CH_2{=}CH(CF_2)_nY$ is preferred. In such a case, n in the formula is preferably from 2 to 6, since its molded product will be excellent in stress crack resistance, and n=2 to 4 is most preferred.

The content of repeating units based on FAE in the ETFE composition is preferably from 0.01 to 10 mol %, more preferably from 0.1 to 7 mol %, further preferably from 0.4 to 4 mol %, in the entire repeating units in ETFE. If the content of FAE is less than the above range, the stress crack resistance of a molded product to be formed from the ETFE composition tends to be low, and there may be a case where a breaking phenomenon such as cracking under a stress may sometimes occur, and if it exceeds the above range, the mechanical strength of the composition may sometimes be low.

Method for Producing ETFE

The method for producing ETFE in the present invention may, for example, be (1) a method wherein the molecular weight is adjusted during the polymerization, (2) a method wherein an energy such as heat or radiation is applied to ETFE obtained by polymerization to cleave the molecules to lower the viscosity, or (3) a method wherein a molecular chain of ETFE obtained by polymerization is chemically cleaved by radicals, i.e. ETFE and an organic peroxide are melt-kneaded by an extruder to cleave the molecular chain of ETFE by generated radicals to reduce the viscosity. In principle, any one of the methods may be applicable. However, the methods (2) and (3) have a problem such that active functional groups such as carbonyl groups are likely to be formed at the cleaved portions in ETFE, whereby undesirable adhesiveness, etc. are likely to result. Accordingly, the method (1) is most preferred, since no such active functional groups will be formed in the obtainable ETFE, and the productivity is high.

In the present invention, the method for polymerizing ETFE is not particularly limited, and a method is usually employed wherein ethylene and tetrafluoroethylene are introduced into a reactor and copolymerized by means of a commonly employed radical polymerization initiator or chain transfer agent. The polymerization method may, for example, be bulk polymerization known per se; solution polymerization using, as a polymerization medium, an organic solvent such as a fluorinated hydrocarbon, a chlorinated hydrocarbon, a fluorinated chlorohydrocarbon, an alcohol or a hydrocarbon; suspension polymerization using, as a polymerization medium, an aqueous medium and, if necessary, a suitable organic solvent; or emulsion polymerization using, as a polymerization medium, an aqueous medium and an emulsifier. However, a solution polymerization is most preferred wherein ethylene and tetrafluoroethylene as a fluorinated monomer are copolymerized in the presence of a radical polymerization initiator, a chain transfer agent and a polymerization medium. The polymerization may be carried out in a batch system or in a continuous system by using a single reactor or multi reactor system stirring type polymerization apparatus, tubular type polymerization apparatus, etc.

The radical polymerization initiator is preferably an initiator whereby the temperature at which the half-life period is 10 hours, is from 0 to 100° C., more preferably from 20 to 90° C. For example, an azo compound such as azobisisobutyronitrile; a peroxydicarbonate such as diisopropyl peroxydicarbonate; a peroxyester such as tert-butyl peroxypivalate, tert-butyl peroxyisobutyrate or tert-butyl peroxyacetate; a non-fluorinated diacyl peroxide such as isobutyryl peroxide, octanoyl peroxide, benzoyl peroxide or lauroyl peroxide; a fluorinated diacyl peroxide such as $(Z(CF_2)_pCOO)_2$ (wherein Z is a hydrogen atom, a fluorine atom or a chlorine atom, and p is an integer of from 1 to 10); or an inorganic peroxide such as potassium persulfate, sodium persulfate or ammonium persulfate, may, for example, be mentioned.

The polymerization medium may, for example, be an organic solvent such as a fluorinated hydrocarbon, a chlorinated hydrocarbon, a fluorinated chlorohydrocarbon, an alcohol or a hydrocarbon as mentioned above, or an aqueous medium.

The chain transfer agent may, for example, be an alcohol such as methanol or ethanol; a chlorofluorohydrocarbon such as 1,3-dichloro-1,1,2,2,3-pentafluoropropane or 1,1-dichloro-1-fluoroethane; or a hydrocarbon such as pentane, hexane or cyclohexane. The amount of the chain transfer agent is usually at a level of from 0.01 to 100 mass %, based on the polymerization medium. By adjusting the concentration of the chain transfer agent, it is possible to adjust the melt viscosity (the molecular weight) of ETFE thereby obtainable. That is, as the concentration of the chain transfer agent is made to be high, it is possible to obtain ETFE having a low molecular weight.

Particularly, in the case of producing an ethylene/tetrafluoroethylene copolymer having a low molecular weight to be preferably used in the present invention, it is also preferred to use 1,3-dichloro-1,1,2,2,3-pentafluoropropane which is usually used as a chain transfer agent, as a polymerization medium.

The polymerization conditions are not particularly limited, but the polymerization temperature is usually from 0 to 100° C., more preferably from 20 to 90° C. Further, the polymerization pressure is preferably from 0.1 to 10 MPa, more preferably from 0.5 to 3 MPa. As the polymerization pressure becomes high within the above range, a molecular weight of the polymer thereby obtainable tends to be high, and the melt viscosity tends to be high, whereby by adjusting the polymerization pressure, it is possible to adjust the melt viscosity. The polymerization time may vary depending upon the polymerization temperature and the polymerization pressure, etc., but it is usually from 1 to 30 hours, more preferably from 2 to 10 hours.

The amount of ETFE relative to the polymerization medium at the termination of the polymerization reaction is usually at a level of from 0.03 to 0.2 g/cm$^3$, and by this concentration, the molecular weight of ETFE can be adjusted. That is, by adjusting the ETFE concentration to be low within the above range, it is possible to obtain ETFE having a low molecular weight.

The above mentioned ETFE (A) and ETFE (B) can be produced in the same manner.

Blend of ETFE (A) and (B)

In a case where ETFE of the present invention is a mixture of ETFE (A) and ETFE (B), by using a single screw or twin screw extruder, ETFE (A) and (B) with a desired mass ratio are put into it and melted, and the two resins are sufficiently melt-kneaded. The melt-kneading temperature is preferably from 120 to 360° C.

The Method for Producing the Nonwoven Fabric

As the method for producing the nonwoven fabric made of ETFE of the present invention, general methods for producing nonwoven fabrics wherein continuous fibers are produced, such as a spun bond method or a melt blow method may be applied. Among them, in the case of the melt blow method, since fibers of ETFE can be formed, while forming a nonwoven fabric product, the productivity can be high. Further, ETFE fibers which constitute the nonwoven fabric can be extremely fine.

The nonwoven fabric made of ETFE of the present invention is made of ETFE continuous fibers. In the present invention, the continuous fibers mean that fibers have an aspect ratio of at least 10,000, where the aspect ratio of fibers=length of fibers/diameter of fibers.

The average fiber diameter (diameter) of the continuous fibers is preferably from 0.01 to 5 μm. The smaller the fiber diameter of the continuous fibers is, the smaller the maximum pore diameter of the nonwoven fabric to be produced becomes. However, if the fiber diameter is too small, the tensile strength per one fiber becomes weak, and it may sometimes be difficult to substantially use the fibers from the viewpoint of handling. The average fiber diameter is more preferably from 0.01 to 3 μm. Consequently, the fiber length is preferably at least 0.1 mm, and when the fiber length is at least 20 mm, fibers are sufficiently twined one another, whereby a nonwoven fabric which is excellent in the mechanical properties can be obtained.

FIG. 1 is a cross-sectional view showing one embodiment in cross section of a nozzle used in an apparatus for producing nonwoven fabrics by the melt blow method. In the melt blow method, molten ETFE 1 is dispensed from an outlet 3 of a fiber spinning nozzle in a molten state, and stretched and spun by gas 2 discharged from an outlet 4 of a gas discharge nozzle disposed in the vicinity of the fiber spinning nozzle to obtain continuous fibers. The continuous fibers are collected on an air-suction surface to form a nonwoven fabric.

The shape of the outlet 4 of the gas discharge nozzle disposed in the vicinity of the fiber spinning nozzle is preferably a ring slit form. The slit width is preferably from 100 to 1,500 μm, more preferably from 200 to 1,000 μm, further more preferably from 300 to 800 μm.

The temperature of gas 2 discharged from the outlet 4 of the gas discharge nozzle is preferably from 320 to 400° C., more preferably from 330 to 390° C., further more preferably from 340 to 380° C.

The amount of gas 2 discharged from the outlet 4 of the gas discharge nozzle is preferably from 0.5 to 10 Nm$^3$/hr, more preferably from 1 to 7 Nm$^3$/hr, further more preferably from 2 to 5 Nm$^3$/hr per 1 cm of the nozzle.

Further, the temperature of a die in the melt blow method is preferably from 320 to 380° C., more preferably from 340 to 360° C. Within the above temperature range, molding can be carried out with low pressure loss.

The air-suction surface may, for example, be an apparatus capable of forming dispensed very fine fibers into a fabric form by sucking air through one side of a film form base material in a reduced pressure state. The film form base material having gas permeability is not particularly restricted, and a mesh, a cloth or a porous material may, for example, be mentioned. Its material is not also particularly restricted, however, in order to form ETFE into a nonwoven fabric, a mesh made of a metal is preferred, since its melting point is high. As the mesh made of a metal, for example, a mesh made of stainless steel is preferred.

As the air-suction function, it is preferred for the nonwoven fabric to have a sucking ability to sufficiently suck and maintain the spun continuous fibers in the form of a fabric. Accordingly, the air-suction surface preferably has a wind speed of at least 0.1 m/s in a distance of 1 cm from the surface. Further, if apertures of the air-suction surface is too large, the fibers themselves are withdrawn into the interior of the mesh, and cannot be peeled off, or the smoothness will be lost. Therefore, the apertures of the mesh are preferably at most 2 mm, more preferably at most 0.15 mm, further preferably at most 0.06 mm, particularly preferably at most 0.03 mm.

In a case where the film form base material having air-suction ability has flexibility, by putting it on a conveyor which can continuously rotate it, the conveyor can be used as a conveyor having the air-suction function for collection. For example, a method will be possible wherein a film form base material wound up into a roll is continuously dispensed, and a nonwoven fabric is formed on one side of the base material, then separated and wound up, whereby the production method can be simplified.

The bulk density of the obtainable nonwoven fabric depends on the hardness or thermal properties of ETFE to be used. In the present invention, by employing the melt blow method and using ETFE having a low viscosity, it is possible to directly obtain a nonwoven fabric wherein a part of intersections of the ETFE fibers is fused one another. Further, in some cases, since the above fusion does not occur, a web (precursor of nonwoven fabric) is obtained, which may be collected by a conveyor for collection having an air-suction function and subjected to press bonding as it is, to obtain an ETFE nonwoven fabric having a predetermined bulk density.

In the above method for producing the ETFE nonwoven fabric, if intersections among the ETFE fibers are not fused, operation of winding, etc. or handling is difficult. When at least a part of intersections of the ETFE fibers is fixed, elasticity or a strength can be expressed as a single nonwoven fabric. As a result, a self-supporting property is expressed on the nonwoven fabric itself, and the handling efficiency can be improved. Embodiments wherein at least a part of intersections of the ETFE fibers is fixed, may, for example, be (1) the case where the fibers are fused one another when the continuous fibers are collected to form a nonwoven fabric, (2) the case where the fibers are fused one another by hot pressing the nonwoven fabric and (3) the case where intersections of the fibers are bound by coating the nonwoven fabric with a solution containing a binder comprising a solvent soluble fluoropolymer, as mentioned above.

The hot pressing in the above embodiment (2) is preferably carried out within a temperature range such that the fibers can be fused without melt-deforming. Such a temperature range depends on thermal properties of a fluororesin which constitutes fibers, however, in the case of the ETFE used in the present invention, the temperature range is preferably from "melting point−85° C." to the melting point, more preferably from "melting point−70° C." to the melting point. Further, the pressure at the time of the hot pressing depends on the above temperature condition, however, usually if the hot pressing is carried out within a pressure range of from 0.5 to 10 MPa, the fibers can be fused without large deformation. Further, in a roll press method which is often used as an example of the above hot pressing, by controlling the melt viscosity of the ETFE used in the present invention, a polyethylene terephthalate (hereinafter referred to as PET) film which is relatively inexpensive can be used as a support. Further, without using a calendering roll which is constructed by two rolls of a metal roll-a metal roll and of which apparatus cost is relatively high, both operations of the densification of the nonwoven fabric and a temporary press bonding of the nonwoven fabric of a PET support can be simultaneously carried out by using a conventional roll lamination apparatus which is constructed by two rolls of a metal roll-a rubber roll. Thus, even though the fabric to be produced is a web which is very low cloth weight, while suppressing deformation due to handling, etc. at the minimum, various post processing can be carried out.

Here, if the melt viscosity at 240° C. is lower than 100 Pa·s, the fibers are crushed, apertures as the nonwoven fabric tends to be crushed, the allowable range of the press temperature and the press pressure are narrow, and productivity becomes poor. Further, if the melt viscosity at 240° C. exceeds 1,500 Pa·s, the nonwoven fabric is not sufficiently densified, and the temporary press on PET cannot be carried out. Further, if the problem is solved by raising the roll temperature, the deformation of PET begins, and it is difficult to continuously form a film stably.

Figure 2:
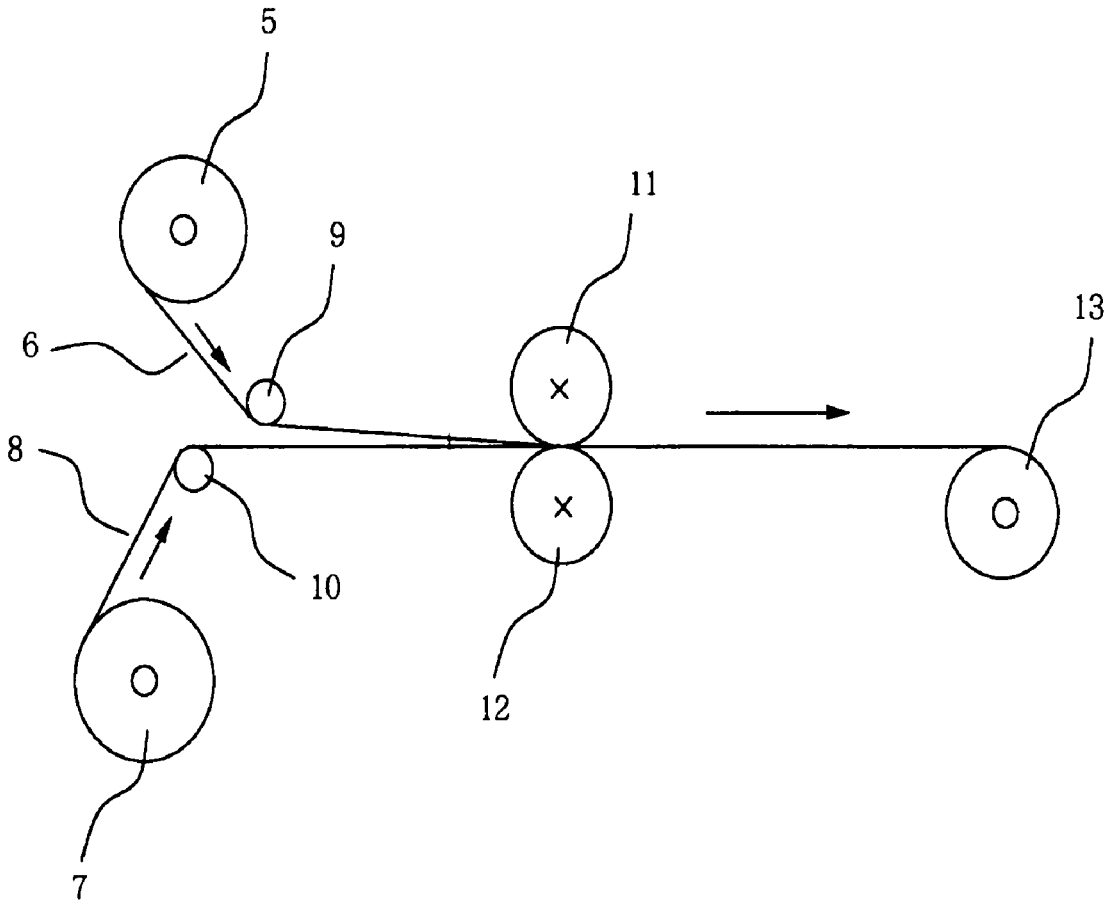
FIG. 2 is a schematic view of a simple lamination apparatus for a nonwoven fabric and a substrate film.

The apparatus for carrying out the roll press method may, for example, be a simple lamination apparatus shown in FIG. 2. In FIG. 2, an ETFE nonwoven fabric 6 is sent off from an ETFE nonwoven fabric raw fabric roll 5, and a PET base material film 8 is sent off from a PET base material film raw fabric roll 7. Then, the ETFE nonwoven fabric 6 and the PET base material film 8 are laminated between the metal roll 11 and the rubber roll 12, pressure is applied by hot pressing, and a densified PET base material film supported nonwoven fabric is wound up by wind-up roll 13. Here, the same temperature and pressure of hot press are employed as the above.

In the above embodiment (3), the solvent soluble fluoropolymer to be used for binding intersections of the fibers is meant for a fluoropolymer which can be dissolved by a solvent and which can be present in the form of a solution at a concentration of at least 0.1% at room temperature. Further, in the present specification, the solution includes a liquid which is microscopically observed as a solution although macroscopically, the fluoropolymer is present as dispersed or in a swelled state.

Since the above binder is made of a fluoropolymer, it is excellent in the chemical durability in the environment in which nonwoven fabrics are used. The fluoropolymer is preferably a polymer wherein all hydrogen atoms bonded to carbon atoms are substituted by fluorine atoms. Further, since the elastic modulus and the strength of the nonwoven fabric bonded with the binder can be improved, the elastic modulus of the solvent soluble fluoropolymer is preferably high. The fluoropolymer preferably has an elastic modulus of at least 0.1 MPa at room temperature, more preferably has an elastic modulus of at least 100 MPa at room temperature. Further, the glass transition temperature of the fluoropolymer is preferably at least room temperature, more preferably at least 40° C.

The maximum pore diameter of the ETFE nonwoven fabric of the present invention is preferably at most 100 μm, more preferably at most 70 μm, furthermore preferably at most 40 μm, particularly preferably at most 20 μm.

The unit weight of the ETFE nonwoven fabric of the present invention is preferably from 1 to 300 g/m$^2$, more preferably from 3 to 200 g/m$^2$, furthermore preferably from 5 to 150 g/m$^2$.

The strength of the ETFE nonwoven fabric of the present invention per 100 g/m$^2$ of unit weight in a machine direction is preferably at least 0.5 kg/5 cm, more preferably at least 1.0 kg/5 cm, further more preferably at least 1.5 kg/5 cm.

In the ETFE used in the ETFE nonwoven fabric of the present invention, an ETFE having at least one functional group selected from the group consisting of an acid anhydride residual group, a carboxyl group, a hydroxyl group, an epoxy group, a hydrolyzable silyl group, an alkoxycarbonyl group and an acid halide group, is contained. In a case where a hydrophilic property on a surface of the ETFE fibers is adjusted, or another material is laminated or adhered to improve properties (heat resistance, chemical resistance, mechanical strength, hydrophilic property, hydrophobic property, adherent property to a material to be supported, a tight property to a substrate, etc.) of the nonwoven fabric, the ETFE having a functional group is preferred, since the tight property of both interfaces can be improved.

As a method for introducing the functional group into an ETFE, preferred is radiation irradiation, plasma irradiation, corona discharging, chemical treatment with metal sodium or method of introducing the functional group at the time of producing ETFE. The method of introducing the functional group at the time of producing ETFE may, for example, be (1) a method of copolymerizing comonomer having the functional group at the time of polymerizing ETFE, (2) a method of polymerizing ETFE in the presence of a polymerization initiator or a chain transfer agent having the functional group to introduce the functional group at an end of the polymer, (3) a method of kneading a comonomer having the functional group with ETFE, followed by radiation irradiation or (4) a method of kneading a comonomer having the functional group, ETFE and a radical initiator, followed by melt extrusion them to graft-polymerize the comonomer having the functional group to a fluororesin.

Among them, preferred is a method that a fluoromonomer and a comonomer having a functional group such as a monomer having an unsaturated bond with itaconic acid anhydride or a ring acid anhydride such as citraconic acid anhydride (hereinafter referred to as acid anhydride monomer) are copolymerized, as described in JP-A-2004-238405. The comonomer having a functional group is preferably itaconic acid anhydride or citraconic acid anhydride, more preferably itaconic acid anhydride.

The content of the functional group in ETFE is preferably from 0.01 to 10 mol % ((the number of mols of the functional group/the number of mols of the total repeating units of the polymer)×100%, the same applies hereinafter), more preferably from 0.05 to 5 mol %, most preferably from 0.1 to 3 mol %. If the amount of the functional group is less than 0.01 mol %, the effects of the present invention may not be obtained, and if the amount of the functional group exceeds 10 mol %, the physical properties of the fluororesin themselves may deteriorate.

In a case where ETFE is used in combination with another material, at least one type of ETFE (molecular weight, composition or a contained functional group is different) is preferably used in combination with another material, and more than two such another material may be used. Such another material may, for example, be a resin.

The resin combined with the ETFE is preferably a thermoplastic resin or a thermoplastic elastomer. The thermoplastic resin may, for example, be an olefin resin such as a polyethylene resin (high density polyethylene resin, a middle density polyethylene resin, a low density polyethylene resin or an ultralow density polyethylene resin), a polypropylene resin, a polybutene resin, a polybutadiene resin or an α-olefin-ethylene copolymer; a polyester resin such as a polybutylene terephthalate resin, a polyethylene terephthalate resin, a polyethylene isophthalate resin or a polyethylene naphthalate resin; a polyurethane resin such as a thermoplastic polyurethane resin; a polyacetic acid vinyl resin such as a polyacetic acid vinyl resin or an ethylene/acetic acid vinyl resin; a polyvinyl alcohol resin such as a polyvinyl alcohol resin or a vinyl alcohol/ethylene copolymer resin; a polyvinyl chloride resin such as a polyvinyl chloride resin, a polyvinylidene chloride resin or a vinyl chloride/vinylidene chloride copolymer resin; a poly(meth)acrylate resin such as a polymethyl acrylate resin, a polyethyl acrylate resin, a polymethacrylate resin or a polyethyl methacrylate; a polystyrene resin such as a polystyrene resin or a poly α-methylstyrene resin; a polynitrile resin such as a polyacrylonitrile resin, a polymethacrylonitrile resin, an acrylonitrile/styrene copolymer resin, a methacrylonitrile/styrene copolymer resin, a methacrylonitrile/styrene/butadiene copolymer resin; a polyamide resin such as a nylon 11 resin, a nylon 12 resin, a nylon 610 resin, a nylon 612 resin, a nylon 66 resin or a nylon 46 resin; a polyimide resin such as a polyimide resin, a polycarbonate resin, a polyether ether ketone resin, a polyether imide resin, a polyether ketone resin, a polyether sulfone resin, a polythioether sulfone resin, a polyether nitrile resin or polyphenylene ether resin.

Further, the thermoplastic elastomer may, for example, be a polyurethane thermoplastic elastomer such as a polyether type or a polyester type; a polyolefin thermoplastic elastomer such as an ethylene/propylene copolymer elastomer, an ethylene/propylene/diene copolymer elastomer; a polyester thermoplastic elastomer; a polystyrene thermoplastic elastomer such as a styrene/ethylene/butylene block copolymer elastomer, a styrene/ethylene/propylene block copolymer elastomer or a styrene/isoprene copolymer elastomer; or a polyamide thermoplastic elastomer.

Further, the ETFE nonwoven fabric of the present invention with another material may be formed into a laminate fiber material by coextrusion molding. Further, the ETFE nonwoven fabric of the present invention may be multilayered with a nonwoven fabric other than the ETFE nonwoven fabric of the present invention, a woven fabric, a film or a sheet to obtain a multilayer fiber material.

The ETFE nonwoven fabric of the present invention (including the ETFE nonwoven fabric of the present invention into which a functional group is introduced), the laminate fiber material of the ETFE nonwoven fabric of the present invention with another material and the multilayer fiber material may, for example, be used as a fine fiber nonwoven fabric which is particularly useful as a separator for cells, a water treatment film, a separation film for a membrane bioreactor, a gas separation film, an oil filter, an automobile/device integral filter, a mask/wet wiper, an acoustic/heat insulation/firer retardant material, an abrasive, a printed board/flexible print circuit (FPC) board, a fabric material for medicine, a filter, a heat insulator, a moisture penetration waterproof material, or a flame repellent material.

The characteristics of ETFE may, for example, be a high durability against repeating stress which is required for coating fine wires for industrial robots, so-called high cut through resistance property which will not break even if bending load is applied by applying an original rupture point toward the vertical direction of a product having a small diameter, a high temperature durability or another mechanical strength.

The ETFE used for the ETFE nonwoven fabric of the present invention has a high melt flowability such that the melt viscosity measured at 240° C. is higher than 100 Pa·s to 1,500 Pa·s. The ETFE nonwoven fabric of the present invention which employs such an ETFE has such a strong fiber characteristic that although the average fiber diameter is small, the mechanical strength is sufficient.

Particularly, in a case where the nonwoven fabric is produced by the meltblow process, it is possible to form extremely fine ETFE fibers which construct the nonwoven fabric, as mentioned above.

Even if a nonwoven fabric of conventional resins is formed by the meltblow process, only a nonwoven fabric having the average fiber diameter of about 5 μm at the most (about 3 μm at the finest) can be produced. Further, if fine fibers having the average fiber diameter of at most 3 μm is tried to produce, such fibers are often cut at the vicinity of an outlet of a nozzle, short-length fiber aggregates which is called as fly float, the yield of the fiber tends to be low, and productivity of nonwoven becomes remarkably bad. On the other hand, by using the ETFE of the present invention having a high melt flowability, it is possible to produce a nonwoven fabric having a remarkably small average fiber diameter at the level of 0.8 μm with high productivity, and it is possible to reduce cost for producing a nonwoven fabric having an extremely small diameter.

Even though the ETFE nonwoven fabric of the present invention has such a small average fiber diameter, by the elasticity and the strength of individual ETFE fiber, the nonwoven fabric is self-supported so long as the nonwoven fabric has a thickness of at least 2 μm, whereby the nonwoven fabric can be handled alone, and the nonwoven fabric has a sufficient mechanical strength, even though it is thin. Further, the nonwoven fabric has a corrosive resistance against acids and alkalis and can be resist against a high temperature until about 160° C.

Further, the ETFE nonwoven fabric of the present invention can be used as a separator for secondary batteries. A polyethylene/polypropylene mixed spindle form nonwoven fabric is usually used as a separator for nickel-hydrogen cells or nickel-cadmium cells.

Further, a polymer porous film (a sacrificial material is added in a sheet, and the sheet is molded, and then the sacrificial material is melted to form a porous membrane) is usually used as a separator for lithium ion secondary cells.

Further, a expanded Polytetrafluoroethylene (ePTFE) porous media is used as a separator for 4.0 V type lithium ion secondary cells. The ePTFE porous media is excellent in the corrosive resistance and the high temperature characteristics, however, large scale production equipments are required, steps are complicated, and the number of production steps is large, whereby it is expensive.

Further, an aramid fiber nonwoven fabric having a high heat resistance is tried to be used as a separator for lithium ion secondary cells, however, since the thickness of the aramid fiber nonwoven fabric is thick, it is difficult to apply it to 4.0 V type cells which is generally used for the application of cellphones. Therefore, application to 2.5 V type is being considered.

Since the ETFE nonwoven fabric of the present invention employs ETFE, the ETFE nonwoven fabric of the present invention has a high thin moldability which is the characteristic of fluorine type, the corrosion resistance, the moisture resistance, etc., and the ETFE nonwoven fabric of the present invention can be produced by less production steps than the production steps of a separator which employs the ePTFE porous media, whereby cost can be reduced. Further, as mentioned above, even though the thickness made to be thin, the nonwoven fabric has sufficient mechanical strength.

Accordingly, a lithium ion secondary cell which employs the ETFE nonwoven fabric of the present invention as a separator has a sufficient mechanical strength, and the thickness of the separator can be made to be thin, compared to conventional nonwoven fabrics used as a separator for lithium ion secondary cells, and therefore the lithium ion secondary cell can be miniaturized. Further, the ETFE nonwoven fabric of the present invention has the corrosive resistance against acids and alkalis and has a high durability such that it can be resist against a high temperature at a level of 160° C., while cost can be reduced.

EXAMPLES

Now, the present invention will be explained in further detail with reference to Examples. However, the present invention is by no means restricted to such specific Examples. Here, the melt viscosity, composition, melting point, unit weight of ETFE nonwoven fabric, the average fiber diameter, the tensile strength and the maximum pore diameter were measured by the following methods.

Measurement of Melt Viscosity (Pa·s)

An orifice having a diameter of 1 mm and a length of 10 mm was set on a capillary rheometer "Capirograph" having an inner diameter of 9.55 mm, manufactured by Toyo Seiki Seisaku-sho, Ltd., and molten ETFE was extruded under such conditions that the cylinder temperature was 240° C., and the piston speed was 10 mm/min, whereby the melt viscosity was measured.

ETFE Composition (mol %)

Calculated from the results of the measurement of the total fluorine amount and the melt $^{19}$F-NMR measurement.

Melting Point (° C.)

Obtained from the heat absorption peak at the time of heating the sample from room temperature to 300° C. at a rate of 10° C./min in an air atmosphere by using a scanning differential calorimeter (DSC220CU, manufactured by Seiko Instruments Inc.).

Unit Weight and Average Fiber Diameter of Nonwoven Fabric

A PET film with an adhesive was pressed on a nonwoven fabric, and the nonwoven fabric was transferred. The unit weight was measured from the transferred area and an increased weight. Further, from a cross-sectional view of a microscope photograph, the diameter of the nonwoven fabric was measure to calculate the average fiber diameter.

Tensile Strength of Nonwoven Fabric

A bound nonwoven fabric was cut into width 50 mm×length 80 mm within one hour from production, and the tensile test was carried out at a chuck distance of 60 mm at a tensile speed of 30 mm/min to measure the tensile strength of the nonwoven fabric.

The Maximum Pore Diameter of Micropores on Nonwoven-fabric

The maximum pore diameter of micropores on the nonwoven fabric was measured by using a pore size and distribution measuring apparatus (Perm-Prometer, manufactured by PML. Inc.) which is in accordance with ASTM F316-86, JIS K3832.

Preparation Example 1

(1) A polymerization reactor equipped with a stirrer and having an internal capacity of 94 liters, was deaerated, and 87.3 kg of 1,3-dichloro-1,1,2,2,3-pentafluoropropane (AK225cb, manufactured by Asahi Glass Company, Limited, hereinafter referred to as "AK225cb") and 860 g of $CH_2{=}CH(CF_2)_4F$ were charged; the interior of the polymerization reactor was heated to 66° C. with stirring; a mixed gas of TFE/E=89/11 (molar ratio) was introduced until the pressure of the polymerization reactor became 1.4 MPaG; and 677 g of an AK225cb solution containing 1 mass % of tert-butyl peroxypivalate was charged as the polymerization initiator to initiate the polymerization. A mixed gas with a composition of TFE/E=60/40 (molar ratio) and $CH_2{=}CH(CF_2)_4F$ in a ratio corresponding to 3.3 mol % relative to the mixed gas, were continuously charged, so that the pressure was kept constant during the polymerization. After 8 hours from the initiation of the polymerization, and at the time when 7.1 kg of the mixed gas of monomers was charged, the internal temperature of the polymerization reactor was lowered to room temperature, and at the same time, purging was carried out to atmospheric pressure.

(2) The obtained slurry ETFE was put into a 200 L granulation tank having 77 kg of water charged and then heated to 105° C. with stirring to carry out granulation while the solvent was removed by distillation. The obtained granulated product was dried at 150° C. for 5 hours to obtain 7.0 kg of a sample of ETFE (hereinafter referred to as "ETFE 1").

The polymer composition of the ETFE 1 was repeating units based on TFE/repeating units based on E/repeating units based on $CH_2{=}CH(CF_2)_4F$=57.2/40.3/2.5 mol %, and the melting point was 223° C., and the melt viscosity at 240° C. was 110 Pa·s.

Preparation Example 2

(1) Into an evacuated autoclave made of stainless steel having an internal capacity of 430 liters, 164.8 kg of $CF_3(CF_2)_5H$, 168.0 kg of AK-225cb, 3.37 kg of $CF_2{=}CH(CF_2)_4F$ and 89 kg of deionized water were charged; the interior of the autoclave was heated to 65° C. with stirring; a mixed gas of TFE/E=89/11 (molar ratio) was introduced until the pressure of the autoclave became 1.4 MPaG; and 40.1 g of an AK-225cb solution wherein 50 mass % of tert-butyl peroxypivalate was diluted with $CF_3(CF_2)_5H$ so that tert-butyl peroxypivalate became 1 mass %, was charged to initiate the polymerization. A mixed gas with a composition of TFE/E=59/41 (molar ratio) and $CH_2{=}CH(CF_2)_4F$ in a ratio corresponding to 3.3 mol % relative to the mixed gas, were continuously charged, so that the pressure was kept at 1.4 MPaG during the polymerization. 30 kg of a mixed gas of tetrafluoroethylene/ethylene was charged. Then, the autoclave was cooled, and residual gas was purged to terminate the polymerization. The time required for the polymerization was 420 minutes.

(2) The obtained slurry ETFE was put into a 850 liters granulation tank, and the granulation tank was heated, while adding 250 L of water therein. The polymerization solvent, residual monomers, etc. were removed, and 33 kg of a sample of granular ETFE (hereinafter referred to as "ETFE 2") was obtained.

The polymer composition of the ETFE 2 was repeating units based on TFE/repeating units based on E/repeating units based on $CH_2{=}CH(CF_2)_4F$=57.9/39.1/3.0 mol %, and the melting point was 230° C., and the melt viscosity at 240° C. was 1,000 Pa·s.

Preparation Example 3

29 kg of granular ETFE (hereinafter referred to as "ETFE 3") was obtained in the same manner as in Preparation Example 2, except that 192.4 kg of $CF_3(CF_2)_5H$, 141.7 kg of AK-225 and 45 g of an AK-225cb solution wherein 50 wt % of tert-butyl peroxypivalate was diluted with $CF_3(CF_2)_5H$ so that tert-butyl peroxypivalate became 1 wt % were charged. The time required for the polymerization was 390 minutes.

The polymer composition of the ETFE 3 was repeating units based on TFE/repeating units based on E/repeating units based on $CH_2{=}CH(CF_2)_4F$=57.7/39.2/3.1 mol %, and the melting point was 230° C., and the melt viscosity at 240° C. was 1,250 Pa·s.

Preparation Example 4

ETFE 1 was used as ETFE (A), and common ETFE (trade name: FLUON-LM-ETFE-LM-720 A, manufactured by Asahi Glass Company, Limited, melting point: 228° C., melt viscosity: 2,587 Pa·s, (hereinafter referred to as "LM-720")) was used as ETFE (B). ETFE 1 and LM-720 were mixed in a ratio of ETFE 1/LM-720=85/15 (mass ratio) and melt-kneaded at 230° C. by means of a single screw extruder (ϕ20 mm, manufactured by TANABE PLASTIC CO., LTD.) to obtain pellet-form ETFE 4 having the melt viscosity of 200 Pa·s.

Example 1

A single screw type extruder (Diameter of Barrel=30 mm, Length of Barrel/Diameter of barrel ratio=24: manufactured by TANABE PLASTIC CO., LTD.) was equipped with the flow rate controlling structure and a special die having hot air blowing structure as shown in FIG. 1, at its forward end portion, 10 circular outlets each having an inner diameter of 300 μm were disposed linearly within an effective width of 10 cm. A special nozzle for the melt blow nonwoven fabric production (manufactured by Kasen Nozzle MFG. Co., Ltd.) which is capable of blowing hot air from 500 μm of slit so as to apply stretching stress on the discharged resins in parallel with the disposed direction, was used, and ETFE 1 was used. ETFE 1 was jetted at the die temperature of 360° C., at the temperature of hot air for orientation of 360° C. with a flow rate of 3 $Nm^3$/hr per 1 cm of a nozzle, and a nonwoven fabric was formed on a stainless steel mesh set on an air suction device. At that time, the extruder was operated at 5 rpm, and the resin was discharged from the melt blow nozzle at the flow rate of about 0.3 g/min.

The stainless steel mesh was continuously driven to one direction at the velocity of 1 m/min, and a nonwoven fabric continuous body having a width of about 5 cm was formed thereon to prepare 100 g/$m^2$ of a nonwoven fabric.

Although the strength of the nonwoven fabric is slightly low, the nonwoven fabric can be wound around a paper core having an inner diameter of 3 inches and a wall thickness of 7 mm, and a roll form of nonwoven fabric continuous material having a length of 3 m was obtained.

Then, by using a simple lamination apparatus shown in FIG. 2, the nonwoven fabric was laminated and densified with a commercially available polyethylene terephthalate film having a thickness of 100 μm. Further, at the time of the densification, the temperature of the metal roll and the temperature of rubber roll were 170° C., the pressure of the roll applied pressure was 1 kg/m per a roll face of 600 mm, and the feed rate of the continuous film material was 0.15 m/min.

The average fiber diameter of the obtained ETFE nonwoven fabric was 1.16 μm, the unit weight was 100 g/$m^2$, the strength in the machine direction per 100 g/$m^2$ of unit weight was 2.7 kg/5 cm, and the maximum pore diameter was 2.8 μm.

Example 2

A roll form nonwoven fabric continuous material was produced by using the same ETFE 1 as in Example 1 under the same condition. Then, the nonwoven fabric was simply densified by means of a hot press machine (190° C., 2 MPa) The average fiber diameter of the obtained nonwoven fabric was 1.47 μm, the unit weight was 100 g/$m^2$, the strength in the machine direction per 100 g/$m^2$ of unit weight was 6.1 kg/5 cm, and the maximum pore diameter was 3.1 μM.

Example 3

A roll form nonwoven fabric continuous material was produced under the same molding condition, except that ETFE 4 was used, the temperature of the die was 340° C., and the temperature of hot air for orientation was set to be 360° C.

Then, the nonwoven fabric was simply densified by means of a hot press machine (160° C., 1 MPa). The average fiber diameter of the obtained nonwoven fabric was 1.98 μm, the unit weight was 39 g/$m^2$, the strength in the machine direction per 100 g/$m^2$ of unit weight was 2.3 kg/5 cm, and the maximum pore diameter was 12.6 μm.

Example 4

A roll form nonwoven fabric continuous material was produced under the same molding condition as in Example 3 except that ETFE 2 was used.

Then, the nonwoven fabric was simply densified by means of a hot press machine (160° C., 1 MPa). The average fiber diameter of the obtained nonwoven fabric was 6.6 μm, the unit weight was 40 g/$m^2$, the strength in the machine direction per 100 g/$m^2$ of unit weight was 2.9 kg/5 cm, and the maximum pore diameter was 1.32 μm.

Example 5

A roll form nonwoven fabric continuous material was produced under the same molding condition as in Example 3 except that ETFE 3 was used.

Then, the nonwoven fabric was simply densified by means of a hot press machine (160° C., 1 MPa). The average fiber diameter of the obtained nonwoven fabric was 5.26 μm, the unit weight was 120 g/$m^2$, the strength in the machine direction per 100 g/$m^2$ of unit weight was 2.2 kg/5 cm, and the maximum pore diameter was 8.3 μm.

Comparative Example 1

A roll form nonwoven fabric continuous material was produced under the same molding condition as in Example 3, except that conventional ETFE for molding (tradename: FLUON-LM-ETFE-LM-740A, manufactured by Asahi Glass Company, Limited, melting point: 228° C., melt viscosity at 240° C.: 1,750 Pa·s) was used.

Then, the nonwoven fabric was densified by hot press (190° C., 2 MPa). The average fiber diameter of the obtained nonwoven fabric was 10 μm, unit weight was 100 g/$m^2$, the strength in the machine direction per 100 g/$m^2$ of unit weight was 6.4 kg/5 cm, and the maximum pore diameter was 16.9 μm.

The nonwoven fabric was tried to be laminated with a commercially available polyethylene terephthalate film having a thickness of 100 μm and tried to be densified by using the simple lamination apparatus shown in FIG. 2 in the same manner as in Example 1. However, the nonwoven fabric was not sufficiently densified under the same condition, and temporary press with PET could not also be carried out. The roll temperature was raised, however, the condition was not improved, and when the metal roll temperature exceeded 230° C., the PET began to deform, and it was difficult to stably produce a continuous film.

The ETFE nonwoven fabric of the present invention can be used as a particularly useful fine fibers nonwoven fabric such as a separator for cells, a water treatment film, a membrane bioreactor separation film, a gas separation film, an oil filter, an automobile/machine integral filter, a mask/wet wiper, an acoustic/heat insulation/fire retardant material, an abrasive, a print board/flexible print circuit (FPC) board, a fabric material for medicine, a filter, a heat insulating material, a moisture penetration waterproof material or a fire retardant material.

The entire disclosures of Japanese Patent Application No. 2008-055907 filed on Mar. 6, 2008 and Japanese Patent Application No. 2008-105534 filed on Apr. 15, 2008 including specifications, claims, drawings and summaries are incorporated herein by reference in their entireties.

What is claimed is:

1. A nonwoven fabric made of an ethylene/tetrafluoroethylene copolymer, characterized in that the nonwoven fabric is mutually fused continuous fibers of an ethylene/tetrafluoroethylene copolymer which has a melt viscosity of from higher than 100 to 1,500 Pa·s at 240° C.

2. The nonwoven fabric made of an ethylene/tetrafluoroethylene copolymer according to claim 1, wherein the average fiber diameter of the continuous fibers is from 0.01 to 5 μm.

3. The nonwoven fabric made of an ethylene/tetrafluoroethylene copolymer according to claim 1, wherein the maximum pore diameter of the nonwoven is fabric is at most 100 μm.

4. The nonwoven fabric made of an ethylene/tetrafluoroethylene copolymer according to claim 1, wherein the unit weight of the nonwoven fabric is from 1 to 300 g/m$^2$.

5. The nonwoven fabric made of an ethylene/tetrafluoroethylene copolymer according to claim 1, wherein the strength of the nonwoven fabric per unit weight 100 g/m$^2$ in the machine direction is at least 0.5 kg/5 cm.

6. The nonwoven fabric made of an ethylene/tetrafluoroethylene copolymer according to claim 1, wherein the nonwoven fabric is produced by meltblow process.

7. The nonwoven fabric made of an ethylene/tetrafluoroethylene copolymer according to claim 1, wherein the ethylene/tetrafluoroethylene copolymer comprises repeating units based on tetrafluoroethylene, repeating units based on ethylene and repeating units based on a fluoroolefin represented by the formula $CH_2{=}CX(CF_2)_nY$ (where each of X and Y which are independent of each other is a hydrogen atom or a fluorine atom, and n is an integer of from 2 to 8), the molar ratio of the repeating units based on tetrafluoroethylene/the repeating units based on ethylene is from 90/10 to 35/65, and the content of the repeating units based on the fluoroolefin is from 0.01 to 10 mol % based on the total repeating units in the ethylene/tetrafluoroethylene copolymer.

8. The nonwoven fabric made of an ethylene/tetrafluoroethylene copolymer composition according to claim 7, wherein the molar ratio of the repeating units based on tetrafluoroethylene/the repeating units based on ethylene is from 75/25 to 55/45, and the content of the repeating units based on the fluoroolefin is from 0.4 to 4 mol % based on the total repeating units in the ethylene/tetrafluoroethylene copolymer.

9. The nonwoven fabric made of an ethylene/tetrafluoroethylene copolymer according to claim 1, wherein the mutual fusion of the continuous fibers is carried out by hot pressing the nonwoven fabric of the continuous fibers to fuse intersections among the fibers.

* * * * *